US008447047B2

(12) United States Patent
Saraoka et al.

(10) Patent No.: US 8,447,047 B2
(45) Date of Patent: May 21, 2013

(54) INFORMATION PROCESSING APPARATUS AND INFORMATION PROCESSING METHOD

(75) Inventors: Hideto Saraoka, Kanagawa (JP); Takashi Sato, Tokyo (JP); Yasutaka Fujii, Nagano (JP); Tomoyuki Wada, Nagano (JP); Yukimasa Kuwahara, Nagano (JP)

(73) Assignee: Sony Corporation, Tokyo (JP)

( * ) Notice: Subject to any disclaimer, the term of this patent is extended or adjusted under 35 U.S.C. 154(b) by 414 days.

(21) Appl. No.: 12/543,807

(22) Filed: Aug. 19, 2009

(65) Prior Publication Data

US 2010/0061565 A1 Mar. 11, 2010

(30) Foreign Application Priority Data

Sep. 9, 2008 (JP) ..... 2008-231576

(51) Int. Cl.
*H04B 15/00* (2006.01)

(52) U.S. Cl.
USPC ..... 381/94.7; 381/71.6; 381/93; 381/74

(58) Field of Classification Search
USPC ..... 381/7, 26, 28, 71.6, 71.1, 71.13, 381/71.14, 83, 93, 94.2, 94.3, 94.5, 94.7, 381/95; 379/406.01–406.16; 710/69; 455/501, 455/63.1, 570, 114.2, 114.3, 222, 296
See application file for complete search history.

(56) References Cited

U.S. PATENT DOCUMENTS

| | | | | |
|---|---|---|---|---|
| 4,638,451 | A * | 1/1987 | Hester et al. | 710/69 |
| 5,410,604 | A | 4/1995 | Saito et al. | |
| 7,979,868 | B2 * | 7/2011 | de Cesare et al. | 719/321 |
| 8,121,837 | B2 * | 2/2012 | Agapi et al. | 704/233 |
| 2005/0254664 | A1 | 11/2005 | Kwong et al. | |
| 2008/0025523 | A1 | 1/2008 | Miller | |
| 2008/0168475 | A1 * | 7/2008 | de Cesare et al. | 719/321 |
| 2008/0175402 | A1 * | 7/2008 | Abe et al. | 381/71.6 |
| 2008/0188268 | A1 * | 8/2008 | Kim et al. | 455/566 |

FOREIGN PATENT DOCUMENTS

| | | |
|---|---|---|
| JP | 8-79897 | 3/1996 |
| JP | 2004-347866 | 12/2004 |
| JP | 2006-217321 | 8/2006 |
| JP | 2007-129464 | 5/2007 |
| JP | 2008-91255 | 4/2008 |
| JP | 2008-92365 | 4/2008 |
| JP | 2008-92366 | 4/2008 |
| WO | WO 2006/099555 A1 | 9/2006 |

OTHER PUBLICATIONS

Office Action issued Aug. 3, 2010, in Japanese Patent Application No. 2008-231576.

* cited by examiner

*Primary Examiner* — Vivian Chin
*Assistant Examiner* — Leshui Zhang
(74) *Attorney, Agent, or Firm* — Oblon, Spivak, McClelland, Maier & Neustadt, L.L.P.

(57) ABSTRACT

An information processing apparatus includes a jack, a noise-canceling adjustment section, a signal superposition section, an inter-device universal communication bus, and a control section. The jack is connectable with a plug of a headphone including a microphone, outputs a first signal to the headphone, and inputs a second signal from the microphone. The noise-canceling adjustment section generates and outputs, based on the second signal input from the jack, a third signal that cancels a noise component around the headphone. The signal superposition section superposes the third signal on the first signal output from the jack. The control section controls the noise-canceling adjustment section via the inter-device universal communication bus.

12 Claims, 12 Drawing Sheets

INFORMATION PROCESSING APPARATUS AND INFORMATION PROCESSING METHOD

BACKGROUND OF THE INVENTION

1. Field of the Invention

The present invention relates to an information processing apparatus such as a laptop personal computer and an information processing method.

2. Description of the Related Art

Noise-canceling headphones reduce various incoming noises including engine noises and running noises of trains, airplanes, and the like while providing music to users boarded thereon. Further, since users can listen to music with an adequate volume with the noise-canceling headphones, there is no fear that sounds may leak from the headphones.

A noise-canceling headphone includes a microphone for collecting surrounding noises. For example, equipment such as a music reproduction device to which a noise-canceling headphone is connected generates a signal having an opposite phase with respect to a noise collected from the microphone and superposes the signal on a signal to be output to the headphone (see, for example, Japanese Patent Application Laid-open No. 2008-91255 (paragraphs [0054] to [0074], FIG. 13; hereinafter, referred to as Patent Document 1)).

SUMMARY OF THE INVENTION

In Patent Document 1, for example, when a noise-canceling effect is adjusted, it is necessary to control a signal processing section including a noise-canceling signal generation section by a control section.

It is conceivable that such a noise-canceling headphone (including earphones; the same holds true for descriptions hereinafter) is employed for an information processing apparatus such as a laptop personal computer. In this case, since an Audio Codec that serves as an input/output section of a headphone, microphone, or speaker is below the standard, it may be difficult for the Audio Codec to perform control such as an adjustment of a noise-canceling effect under the present circumstances. In addition, in order to realize the adjustment or the like in an environment of GUIs, it is highly likely that the adjustment or the like will be executed at an application level, not at an operating system (OS) level.

There is a need for an information processing apparatus and an information processing method capable of employing a noise-canceling headphone while not changing hardware as much as possible and performing control at an operating system (OS) level.

According to an embodiment of the present invention, there is provided an information processing apparatus including a jack, a noise-canceling adjustment section, a signal superposition section, an inter-device universal communication bus, and a control section.

The jack is connectable with a plug of a headphone including a microphone, and outputs a first signal to the headphone and inputs a second signal from the microphone.

The noise-canceling adjustment section generates and outputs, based on the second signal input from the jack, a third signal that cancels a noise component around the headphone.

The signal superposition section superposes the third signal on the first signal output from the jack.

The control section controls the noise-canceling adjustment section via the inter-device universal communication bus.

In the embodiment of the present invention, the control section controls the noise-canceling adjustment section via the inter-device universal communication bus.

In other words, it is unnecessary for the control section to control the noise-canceling adjustment section via a general Audio Codec. Accordingly, it is possible to employ a noise-canceling headphone while not changing hardware as much as possible. Further, in the inter-device universal communication bus, signals can be exchanged at an operating system (OS) level, specifically, with an audio driver. Accordingly, the noise-canceling adjustment section can be controlled at an operating system (OS) level (without using applications).

According to the embodiment of the present invention, the control section includes one of an I/O controller hub and a system controller hub that outputs an electrical signal for controlling the noise-canceling adjustment section to the inter-device universal communication bus.

The ICH (I/O Controller Hub) or the SCH (System Controller Hub) is provided to a general personal computer. By using such a universal device, the noise-canceling adjustment section can be controlled without changing the device or adding a new device.

According to the embodiment of the present invention, the information processing apparatus further includes a storage section that is connected to the inter-device universal communication bus and stores an initial value of the noise-canceling adjustment section.

For example, a default value for adjusting individual differences of the information processing apparatuses is stored in the storage section as the initial value, with the result that a noise-canceling effect of higher precision can be realized by absorbing variations of the individual differences of the information processing apparatuses.

According to the embodiment of the present invention, the information processing apparatus further includes a detection section to detect, when a plug of an object is connected to the jack, which of the headphone and another object the object is in accordance with a change in a voltage of the jack, and notify, when it is detected that the object is the headphone, a result of the detection to the control section.

By employing such a detection section, it is possible to detect the headphone including a microphone with a simple configuration and switch the noise-canceling effect. Furthermore, it is possible to detect the headphone including a microphone using a general Audio Codec.

According to the embodiment of the present invention, the information processing apparatus further includes an output section to output a signal of an operation screen for adjusting the noise-canceling adjustment section.

Adjustment or the like of the noise-canceling effect can be realized in an environment of GUIs.

In this case, the operation screen for adjusting the noise-canceling adjustment section only needs to display a switch for making a switch as to whether to cancel the noise component around the headphone. Moreover, the operation screen for adjusting the noise-canceling adjustment section only needs to display an adjustment section for adjusting a degree of cancellation of the noise component around the headphone.

According to the embodiment of the present invention, the information processing apparatus further includes an input line to import the second signal input from the jack as a microphone input signal of the information processing apparatus.

Accordingly, the microphone included in the headphone can be used as a normal microphone of the information processing apparatus.

According to another embodiment of the present invention, there is provided an information processing apparatus including an information processing section, an inter-device universal communication bus, a noise-canceling adjustment section, and a signal superposition section.

The information processing section includes a CPU and a controller hub that includes one of an I/O controller hub and a system controller hub.

The inter-device universal communication bus is connected to the controller hub.

The noise-canceling adjustment section is connected to the inter-device universal communication bus and is controlled by the information processing section. The noise-canceling adjustment section generates and outputs, based on a first signal input from a microphone of a headphone, a second signal that cancels a noise component around the headphone.

The signal superposition section superposes the second signal on a third signal output to the headphone.

According to still another embodiment of the present invention, there is provided an information processing method including generating, based on a second signal input from a jack connectable with a plug of a headphone including a microphone, the jack outputting a first signal to the headphone and inputting the second signal from the microphone, a third signal that cancels a noise component around the headphone.

Subsequently, the third signal is superposed on the first signal output from the jack.

Subsequently, generation of the third signal is controlled via an inter-device universal communication bus.

As described above, according to the embodiments of the present invention, the control section controls the noise-canceling adjustment section via the inter-device universal communication bus, with the result that a noise-canceling headphone can be employed while not changing hardware as much as possible. In addition, the noise-canceling adjustment section can be controlled at an operating system (OS) level.

These and other objects, features and advantages of the present invention will become more apparent in light of the following detailed description of best mode embodiments thereof, as illustrated in the accompanying drawings.

DESCRIPTION OF PREFERRED EMBODIMENTS

Hereinafter, embodiments of the present invention will be described with reference to the drawings.

(Configuration of Information Processing Apparatus)

Figure 1:
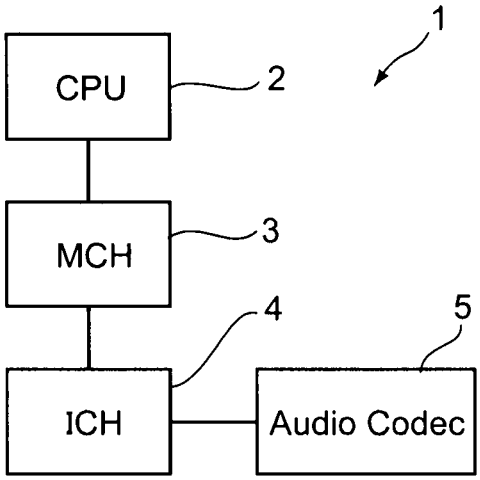
FIG. 1 is a diagram showing a configuration of an information processing apparatus according to an embodiment of the present invention.

FIG. 1 is a diagram showing a configuration of an information processing apparatus according to an embodiment of the present invention. A laptop personal computer exemplifies the information processing apparatus.

As shown in FIG. 1, an information processing apparatus 1 includes a CPU (Central Processing Unit) 2, an MCH (Memory Controller Hub) 3, an ICH (I/O Controller Hub) 4, and an Audio Codec 5.

The CPU 2 controls the respective sections and calculates and processes data.

The MCH 3 is a hub for connecting a memory (not shown) and the CPU 2, or the like.

The ICH 4 is a hub for connecting a PCI bus or a USB to the MCH 3. In the present invention, an SCH (System Controller Hub) may be used in place of the ICH 4.

The Audio Codec 5 is an LSI (Large Scale Integration) used to incorporate a sound function into a mother board (not shown) of the information processing apparatus 1.

Figure 2:
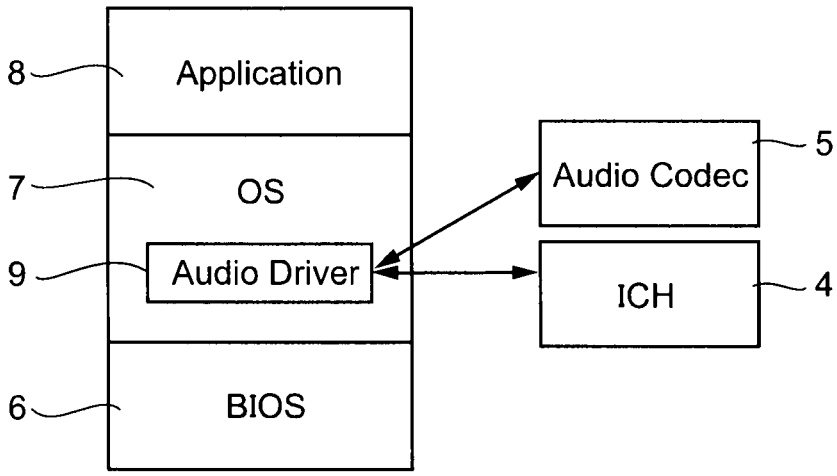
FIG. 2 is a diagram showing a hierarchical structure of software of the information processing apparatus shown in FIG. 1.

FIG. 2 shows a hierarchical structure of software of the information processing apparatus 1.

A BIOS (Basic Input/Output System) 6 is a program group that controls peripheral devices such as a disk drive, a keyboard, a video card (that are not shown) of the information processing apparatus 1.

An OS (Operating System) 7 is a Windows (registered trademark) system, for example. An OS provides basic functions used in common by many application software 8 and controls the whole information processing apparatus 1.

The basic functions include an input/output function such as inputs from a keyboard and outputs to a screen and a function of managing a disc and a memory. The OS 7 includes an Audio Driver 9 for managing the Audio Codec 5 and the ICH 4.

Figure 3:
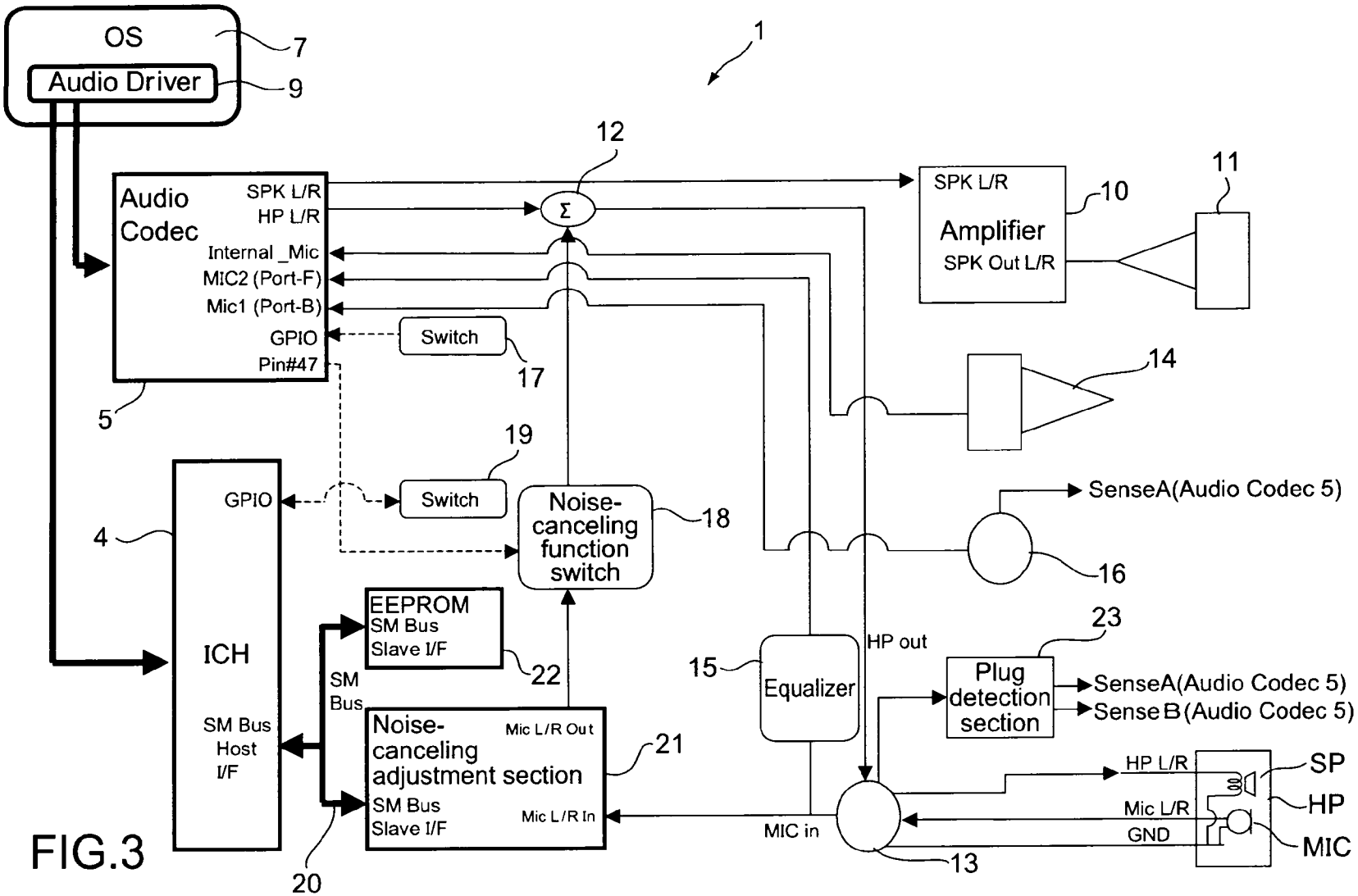
FIG. 3 is a diagram showing a peripheral configuration of an Audio Codec and an ICH shown in FIG. 1 in more detail.

FIG. 3 is a diagram showing a peripheral configuration of the Audio Codec 5 and the ICH 4 in more detail.

As shown in FIG. 3, the Audio Driver 9 included in the OS 7 manages the Audio Codec 5 and the ICH 4 as described above.

The Audio Codec 5 includes terminals of SPK L/R, HP L/R, an Internal_Mic, a Mic2 (Port-F), a Mic1 (Port-B), a GPIO, a Pin#47, and the like. "L/R" refers to two terminals for a left-hand side and a right-hand side.

To the SPK L/R, an internal speaker 11 of the information processing apparatus 1 is connected via an amplifier 10.

To the HP L/R, a headphone-connecting jack 13 is connected via an adder (signal superposition section) 12.

For example, the headphone-connecting jack 13 is a 5-pole jack including a microphone input terminal.

To the headphone-connecting jack 13, a plug of a noise-canceling headphone HP is connectable. The noise-canceling headphone HP includes a speaker SP and a microphone MIC. A microphone noncompliant with noise canceling (not shown) can also be connected to the headphone-connecting jack 13.

To the Internal_Mic, an internal microphone 14 of the information processing apparatus 1 is connected.

To the Mic2 (Port-F), the microphone input terminal of the headphone-connecting jack 13 is connected via an equalizer 15.

To the Mic1 (Port-B), a microphone-connecting jack 16 is connected.

Connected to the GPIO is a switch 17 that is set in accordance with on/off of a noise-canceling function.

To the Pin#47, a noise-canceling function switch 18 is connected.

The ICH 4 includes terminals of a GPIO, an SM Bus Host I/F, and the like.

Connected to the GPIO is a switch 19 that is set in accordance with on/off of the noise-canceling function.

To the SM Bus Host I/F, an SM Bus 20 is connected.

A noise-canceling adjustment section 21 and an EEPROM 22 are connected to the SM Bus 20 in addition to a temperature sensor (not shown) or the like.

The noise-canceling adjustment section 21 includes terminals of an SM Bus Slave I/F, a Mic L/R In, a Mic L/R Out, and the like.

The SM Bus Slave I/F is connected with the SM Bus (inter-device universal communication bus) 20.

To the Mic L/R In, a microphone connection terminal of the headphone-connecting jack 13 is connected.

To the Mic L/R Out, the adder 12 is connected via the noise-canceling function switch 18.

The noise-canceling adjustment section 21 receives, by the SM Bus Slave I/F, a control signal transmitted from the Audio Driver 9 via the SM Bus 20, and is thus controlled by the Audio Driver 9.

The noise-canceling adjustment section 21 generates, based on a signal input from the microphone connection terminal of the headphone-connecting jack 13 to the Mic L/R In, a signal that cancels noise components around the headphone and outputs it from the Mic L/R Out.

For example, the signal that cancels noise components around the headphone is a signal obtained by inverting a phase of the noise components. The noise-canceling adjustment section 21 adjusts a degree of canceling noise components around the headphone and frequency characteristics by the control of the Audio Driver 9.

The EEPROM 22 stores an initial value of the noise-canceling adjustment section 21. For example, the EEPROM 22 stores a setting value of the adjustment device with which an optimum noise-canceling effect is obtained in individual hardware.

Accordingly, it is possible to adjust individual differences of the information processing apparatuses 1 due to hardware implemented.

The Audio Driver 9 controls the noise-canceling function switch 18 via the Audio Codec 5. The noise-canceling function switch 18 makes a switch as to whether to transmit the signal that cancels noise components to the adder 12 or not, the signal being output from the Mic L/R Out of the noise-canceling adjustment section 21. Accordingly, the noise-canceling function switch 18 is a switch for turning on/off the noise-canceling function.

The equalizer 15 changes frequency characteristics such that the signal input from the microphone connection terminal of the headphone-connecting jack 13 can be used as a VoIP Mic.

Accordingly, in the information processing apparatus 1, when the noise-canceling headphone HP is connected to the headphone-connecting jack 13, the noise-canceling headphone HP functions as both a headphone and a microphone.

A plug detection section 23 detects whether or not the plug of the noise-canceling headphone HP is connected to the headphone-connecting jack 13.

The plug detection section 23 detects presence/absence of the connection by a voltage change of a signal line that is connected to a terminal of the plug of the noise-canceling headphone HP through which an audio signal supplied from the microphone is input, out of connection terminals provided to the headphone-connecting jack 13. The plug detection section 23 outputs a headphone detection signal and a microphone detection signal.

In a case where a plug of a headphone noncompliant with noise canceling is connected to the headphone-connecting jack 13, only connection terminals for right- and left-side channel speakers and a ground connection terminal out of the connection terminals provided to the headphone-connecting jack 13 are connected to plug-side terminals.

In this case, since a voltage change does not occur in the audio input line, the plug detection section 23 detects that the headphone-connecting jack 13 is not connected with the plug of the noise-canceling headphone HP. The plug detection section 23 outputs only a headphone detection signal and does not output a microphone detection signal.

When detecting the connection of the plug of the noise-canceling headphone HP, the plug detection section 23 notifies the Audio Driver 9 via the Audio Codec 5 that the noise-canceling headphone HP is connected to the headphone-connecting jack 13.

(Configuration for Detecting Noise-Canceling Headphone)

Figure 4:
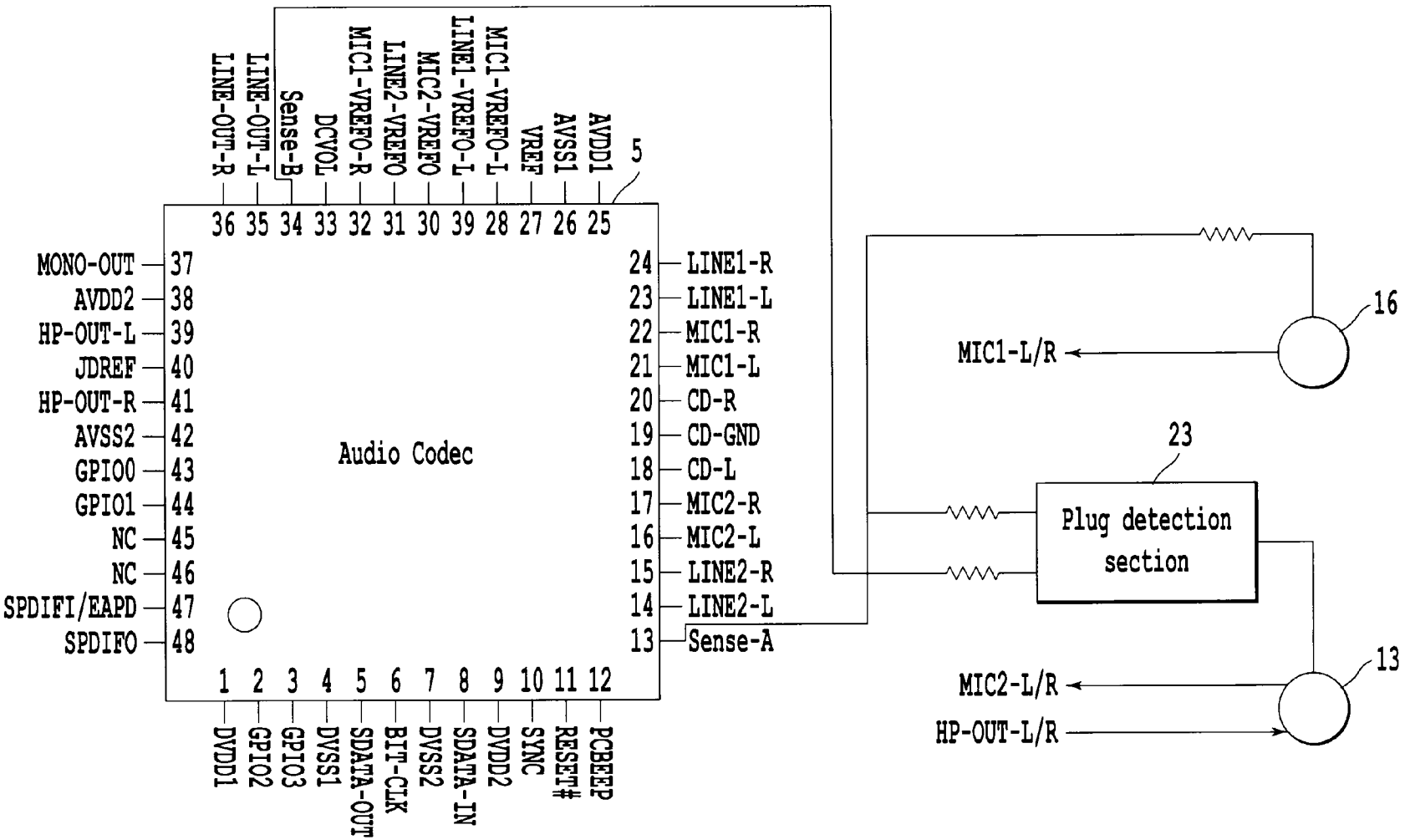
FIG. 4 is a diagram showing a wiring example between a plug detection section and the Audio Codec shown in FIG. 3.

FIG. 4 is a diagram showing a wiring example between the plug detection section 23 and the Audio Codec 5.

As shown in FIG. 4, when a plug of a headphone noncompliant with noise canceling is being connected to the headphone-connecting jack 13, the plug detection section 23 outputs a headphone detection signal. The headphone detection signal is input to a Sense A of the Audio Codec 5.

When a plug of a noise-canceling headphone HP is connected to the headphone-connecting jack 13, the plug detection section 23 outputs a headphone detection signal and a microphone detection signal. The headphone detection signal is input to the Sense A of the Audio Codec 5 and the microphone detection signal is input to a Sense B of the Audio Codec 5.

In the information processing apparatus 1, as shown in FIG. 3, it is necessary to connect the microphone input terminal of the headphone-connecting jack 13 to the Mic2 (Port-F) of the Audio Codec 5 via the equalizer 15. Therefore, the Sense B of the Audio Codec 5 needs to be used to detect the microphone detection signal according to the standard regarding Audio Codec for personal computers.

In the information processing apparatus 1, presence/absence of a microphone is detected using the Sense B of the Audio Codec 5 and thus the connection of a plug of a noise-canceling headphone HP and the connection of a plug of a normal headphone are detected distinctively.

Accordingly, such presence/absence of the connection can be notified to the Audio Driver 9 while conforming to the standard regarding the Audio Codec for personal computers.

When the noise-canceling headphone HP is detected, signals of a headphone output (as normal music reproduction) and a microphone input (as VoIP function) of the noise-canceling headphone HP are input/output to/from the Audio Codec 5.

In this case, as a requirement of the Windows (registered trademark) system mentioned as an example of the OS 7, it is necessary for the Audio Codec 5 to notify the OS 7 that the headphone and the microphone are available. Thus, a detection method for a headphone and microphone, which has been used in personal computers from the past, is used to notify the availability of the headphone and microphone to a system (Audio Driver 9) employing Windows (registered trademark).

Figure 5:
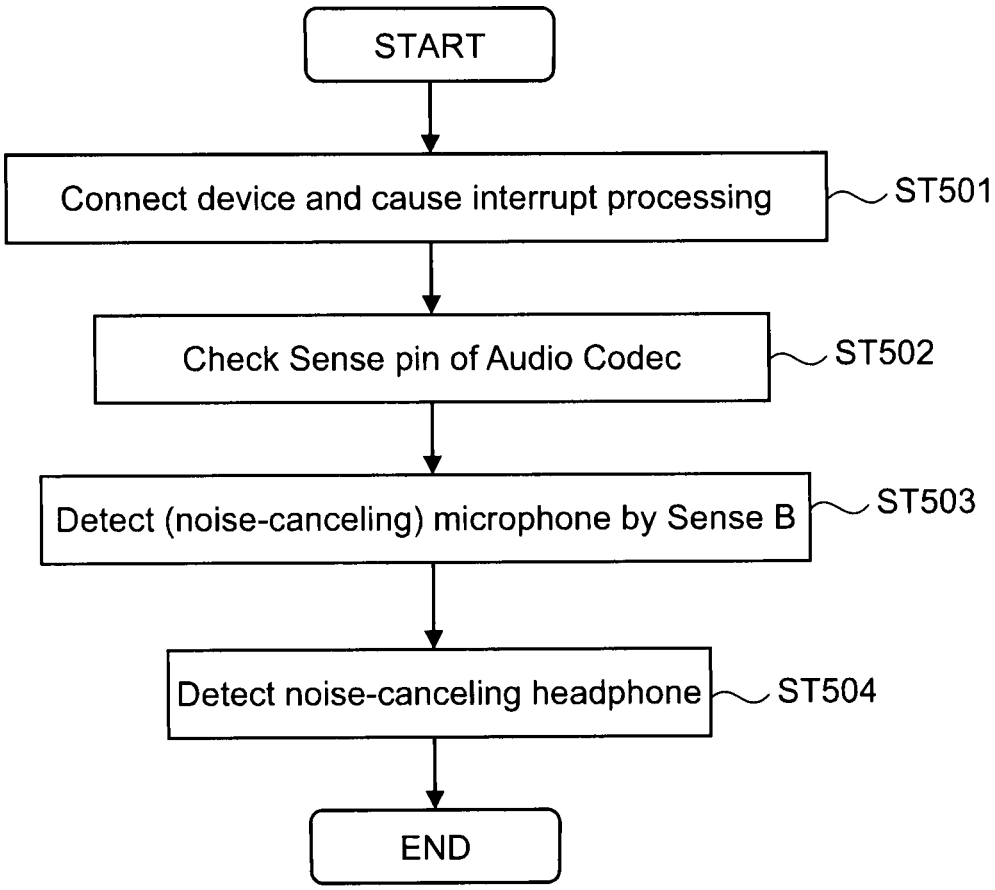
FIG. 5 is a flowchart for describing an operation of detecting a noise-canceling headphone.

Specifically, as shown in FIG. 5, when a device is connected and interrupt processing occurs (Step 501), the Audio Driver 9 checks the Sense pins of the Audio Codec 5 (Step 502).

When the Audio Driver 9 detects a microphone by the Sense B of the Audio Codec 5 (Step 503), the Audio Driver 9 detects the noise-canceling headphone HP (Step 504).

(Basic Operation of Noise-Canceling Function)

When detecting that the noise-canceling headphone HP is connected to the headphone-connecting jack 13, the Audio Driver 9 permits the Audio Codec 5 to output signals from the HP L/R thereof.

The signals output from the HP L/R are added with the signal that cancels noise components around the headphone in the adder 12, and are output to the noise-canceling headphone HP via the headphone-connecting jack 13.

Signals input from the microphone of the noise-canceling headphone HP are input to the Mic L/R In of the noise-canceling adjustment section 21 via the headphone-connecting jack 13. The signals input from the microphone of the noise-canceling headphone HP are signals of noise around the headphone.

In accordance with the noise, the noise-canceling adjustment section 21 generates a signal that cancels noise components around the headphone. The generated signal is output from the Mic L/R Out of the noise-canceling adjustment section 21 to the adder 12.

The Audio Driver 9 controls the noise-canceling adjustment section 21 and the Audio Codec 5. Hereinafter, this point will be described.

(On/Off Control of Noise-Canceling Function)

The information processing apparatus 1 includes a display portion constituted of, for example, a liquid crystal display portion, and on/off as to whether a noise-canceling function is provided to the information processing apparatus 1 is set using a GUI (described below) displayed on the display portion.

Here, during a process of activating the OS 7 starting from an activation of the BIOS 6, the GPIO of the ICH 4 is checked while the BIOS 6 is being activated.

Then, the information processing apparatus 1 checks whether a circuit itself regarding the noise-canceling function is mounted and changes system information of the BIOS 6. Further, during activation of the OS 7, the Audio Driver 9 is incorporated in the system of the OS 7.

At this time, the Audio Driver 9 checks the GPIO of the Audio Codec 5 and changes the specification of the Audio Driver 9, that is, whether to mount an I/F used when the noise-canceling function is present or an I/F used when the noise-canceling function is absent.

Figure 6:
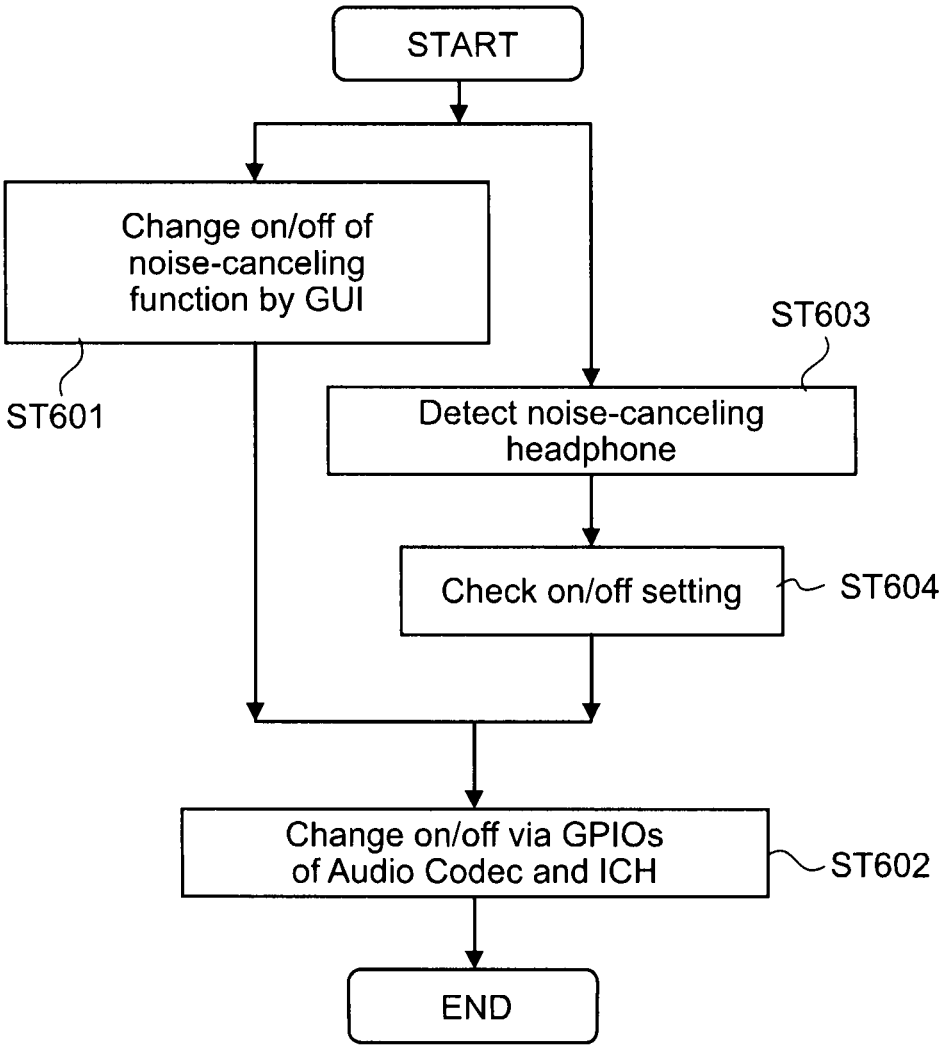
FIG. 6 is a flowchart showing an operation of on/off control of a noise-canceling function.

FIG. 6 is a flowchart showing an operation of on/off control as to whether the noise-canceling function is provided to the information processing apparatus 1.

Upon change of on/off as to whether the noise-canceling function is provided to the information processing apparatus 1 using a GUI (Step 601), the Audio Driver 9 changes on/off of the switch 17 and the switch 19 via the GPIO of the Audio Codec 5 and the GPIO of the ICH 4 (Step 602).

The Audio Driver 9 detects that the noise-canceling headphone HP has been connected to the headphone-connecting jack 13 (Step 603). Then, the Audio Driver 9 checks on/off of the switch 17 and the switch 19 via the GPIO of the Audio Codec 5 and the GPIO of the ICH 4, and checks on/off as to whether the noise-canceling function is provided to the information processing apparatus 1 (Step 604).

The Audio Driver 9 changes on/off of the noise-canceling function switch 18 via the Pin#47 of the Audio Codec 5.

In the information processing apparatus 1, the Audio Codec 5 detects presence/absence of the noise-canceling headphone HP. Therefore, the Audio Driver 9 performs on/off control on the noise-canceling headphone HP by controlling the GPIO of the Audio Codec 5 so that the Audio Driver 9 can perform control for ease of development or the like.

(GUI for Noise-Canceling Function)

Figure 7:
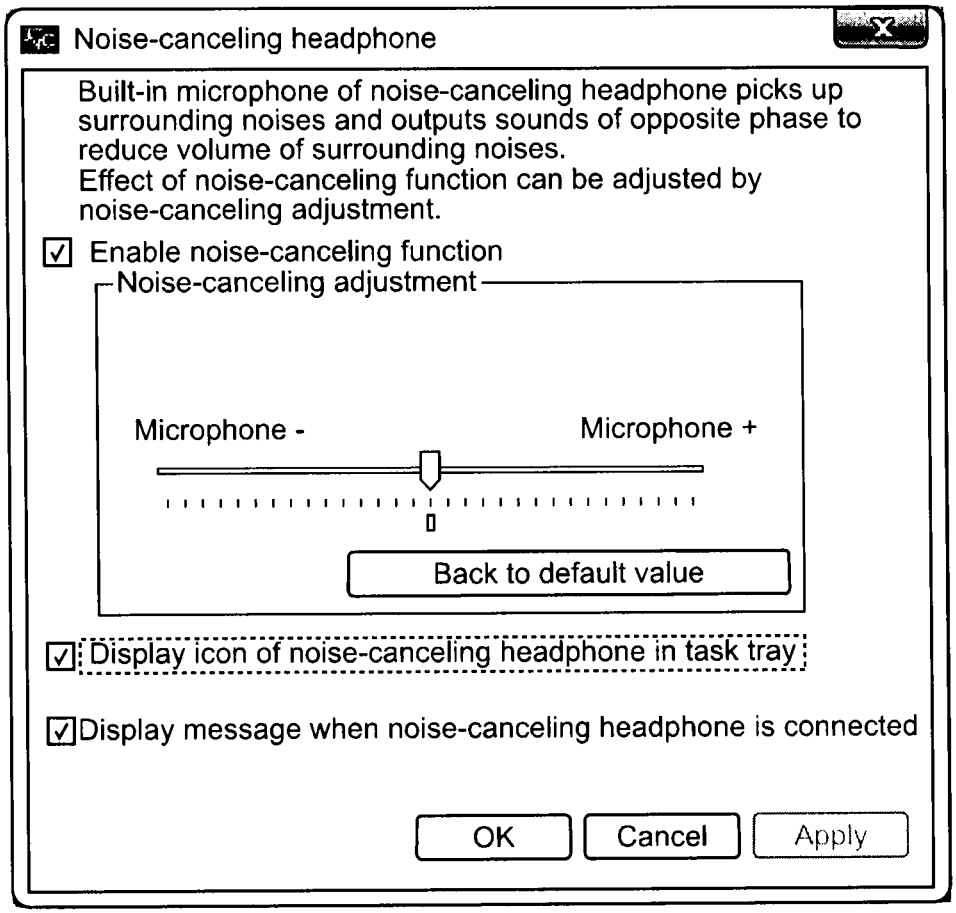
FIG. 7 is a diagram showing an example of a GUI exclusive to the noise-canceling function, the GUI being displayed on a display portion of the information processing apparatus.

FIG. 7 is a diagram showing an example of a GUI exclusive to the noise-canceling function, the GUI being displayed on the display portion of the information processing apparatus 1.

In FIG. 7, "Enable noise-canceling function" is a button for setting on/off of the noise-canceling function already described above.

A slider for "microphone−" and "microphone+" is used to change an effect of the noise-canceling function.

"Back to default value" is a button for setting back the setting of the noise-canceling function to the initial value.

In this embodiment, by using a GUI exclusive to the noise-canceling function, the on/off control of the noise-canceling function is performed by the GPIO control and the change in effect of the noise-canceling function is performed by the SM Bus control as described below. Accordingly, it is possible for the Audio Driver 9 to collectively control the noise-canceling function.

(Change in Effect of Noise-Canceling Function)

In the information processing apparatus 1, the effect of the noise-canceling function is changed using the GUI shown in FIG. 7.

Figure 8:
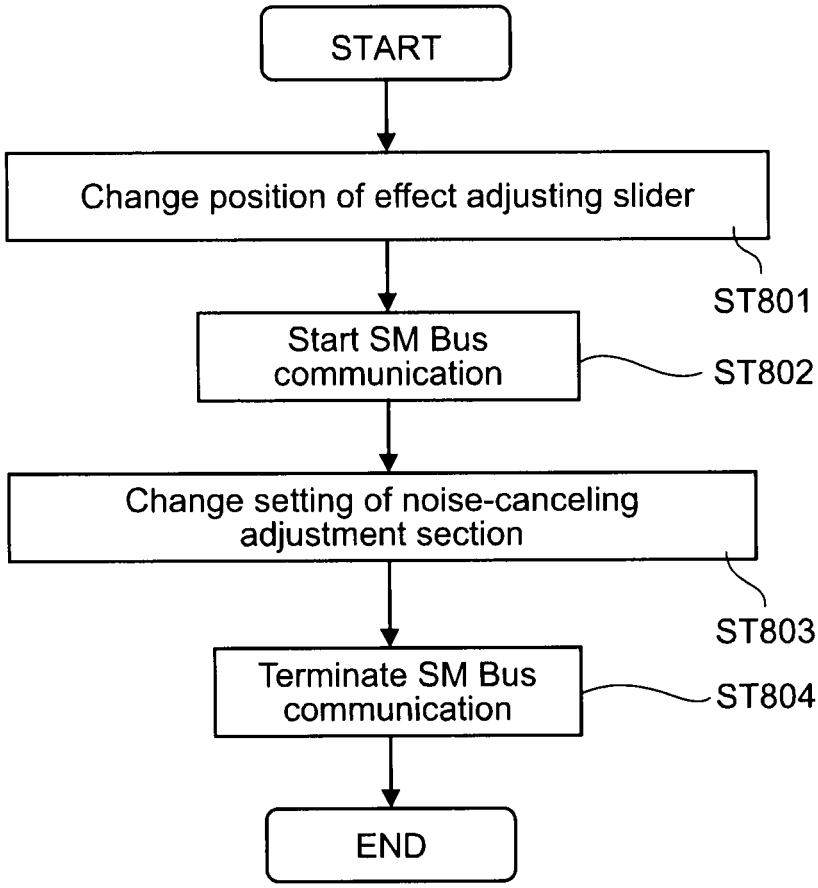
FIG. 8 is a flowchart showing an operation of changing an effect of the noise-canceling function.

FIG. 8 is a flowchart showing an operation of changing an effect of the noise-canceling function.

When a position of the slider for adjusting an effect of the noise-canceling function is changed by the GUI (Step 801), the Audio Driver 9 starts SM Bus communication with the noise-canceling adjustment section 21 via the ICH 4 and the SM Bus 20 (Step 802). The SM Bus communication is a communication method performed via an SM Bus controller.

The Audio Driver 9 changes a setting of the noise-canceling adjustment section 21 using the SM Bus communication, in accordance with the position of the slider for adjusting an effect of the noise-canceling function (Step 803).

The change of the setting of the noise-canceling adjustment section 21 means that, for example, a level of a signal in an opposite phase from the noise is increased to make an effect of the noise-canceling function larger, or conversely, a level of a signal in an opposite phase is decreased to make an effect of the noise-canceling function smaller.

The Audio Driver 9 changes the setting of the noise-canceling adjustment section 21 and then terminates the SM Bus communication (Step 804).

In this embodiment, an effect of the noise-canceling function is changed by the SM Bus communication, with the result that the effect of the noise-canceling function can be changed by the Audio Driver 9.

(Initialization of Noise-Canceling Function)

Figure 9:
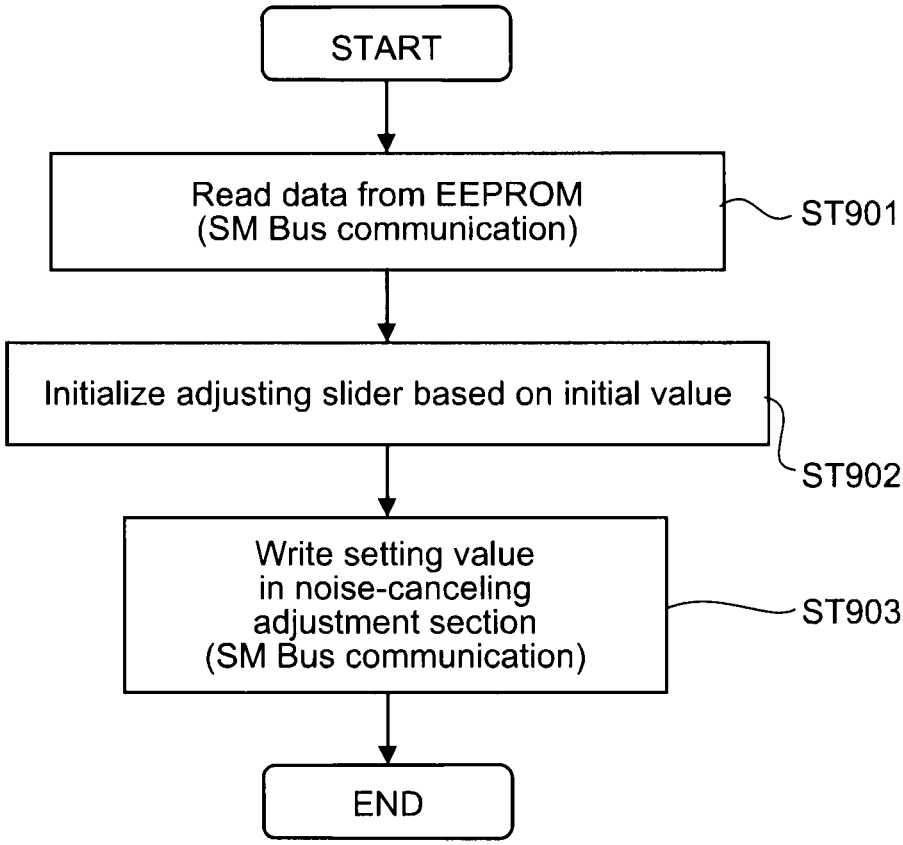
FIG. 9 is a flowchart showing an operation of initializing the noise-canceling function.

FIG. 9 is a flowchart showing an operation of initializing the noise-canceling function.

The Audio Driver 9 reads data of an initial value from the EEPROM 22 via the ICH 4 and SM Bus 20 by the SM Bus communication at a time of activation (Step 901).

The Audio Driver 9 initializes the slider for adjusting a GUI based on the read data of the initial value (Step 902).

The Audio Driver 9 writes the read data of the initial value in the noise-canceling adjustment section 21 by the SM Bus communication (Step 903).

In this embodiment, the initialization of the noise-canceling function can also be performed by the SM Bus communication as described above, with the result that the initialization of the noise-canceling function can be performed by the Audio Driver 9.

(Use of VoIP of Noise-Canceling Headphone HP)

Sounds collected by the microphone of the noise-canceling headphone HP are partially input to the Audio Codec 5 via the equalizer 15 as a microphone input separate from a part used for inverted-noise generation. Accordingly, the microphone of the noise-canceling headphone HP can also be used as a microphone for external connection, with the result that the noise-canceling headphone HP can be used for the VoIP in the information processing apparatus 1

Figure 10:
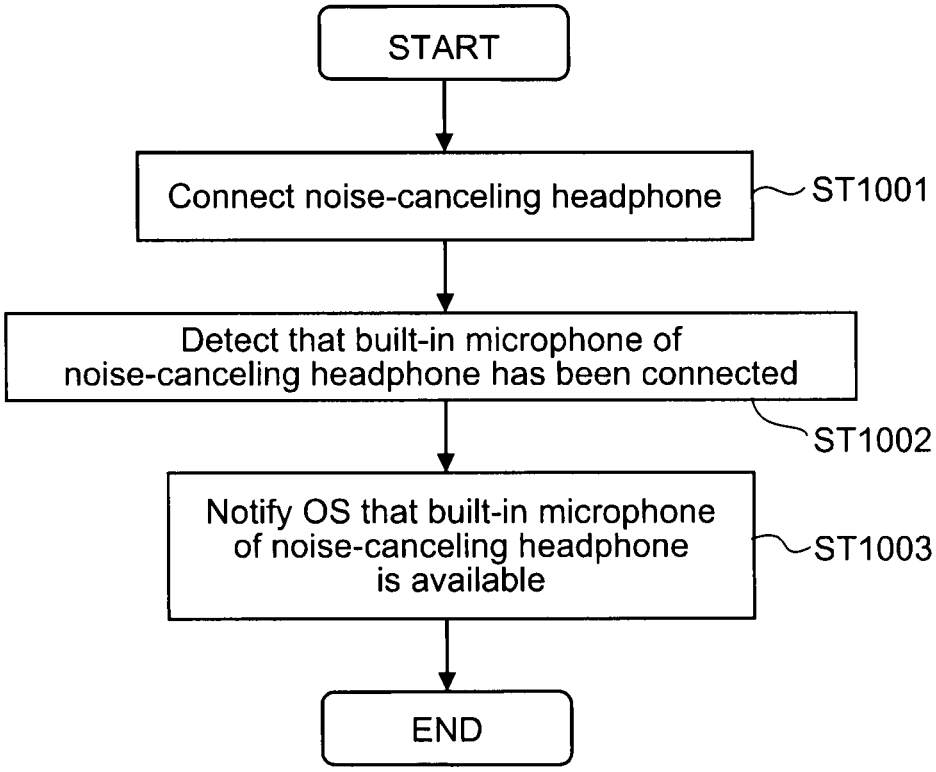
FIG. 10 is a flowchart showing an operation of notifying an OS that a microphone of the noise-canceling headphone is available.

FIG. 10 is a flowchart showing an operation of notifying the OS 7 that the microphone of the noise-canceling headphone HP is available.

When the noise-canceling headphone HP is connected to the headphone-connecting jack 13 (Step 1001), the Audio Driver 9 detects that the microphone of the noise-canceling headphone HP has been connected (Step 1002).

The Audio Driver 9 notifies the OS 7 that the microphone of the noise-canceling headphone HP is available as an external microphone of the information processing apparatus 1 (Step 1003).

Accordingly, the OS 7 can handle the microphone of the noise-canceling headphone HP by the same processing as in the case of the external microphone.

The Audio Driver 9 can perform noise-reduction processing on an input signal that is input from the microphone of the noise-canceling headphone HP to the Audio Codec 5. Accordingly, in the information processing apparatus 1, the noise-reduction processing can be performed on an audio signal to be transmitted to another person when using the VoIP.

(Operational Effect of Embodiment)

In the embodiment described above, the ICH 4 controls the noise-canceling adjustment section 21 via the SM Bus 20. That is, it is unnecessary for the ICH 4 to control the noise-canceling adjustment section 21 via a general Audio Codec. Accordingly, the noise-canceling headphone HP can be employed while not changing hardware as much as possible.

The SM Bus 20 can exchange signals at an operating system (OS) level, specifically, by the Audio Driver 9, with the result that the noise-canceling adjustment section 21 can be controlled at the operating system (OS) level (without using applications).

Further, the ICH 4 includes an ICH 4 (or SCH) that outputs an electrical signal for controlling the noise-canceling adjustment section 21 to the SM Bus 20. The ICH 4 (or SCH) is provided to a general personal computer.

With such a general-purpose device, the noise-canceling adjustment section 21 can be controlled without changing devices or adding new devices.

Moreover, because the EEPROM 22 that is connected to the SM Bus 20 and stores the initial value of the noise-canceling adjustment section 21 is provided, it is possible to absorb variations of individual differences of the information processing apparatuses 1 and realize a noise-canceling effect of higher precision.

(Another Configuration of Information Processing Apparatus)

Figure 11:
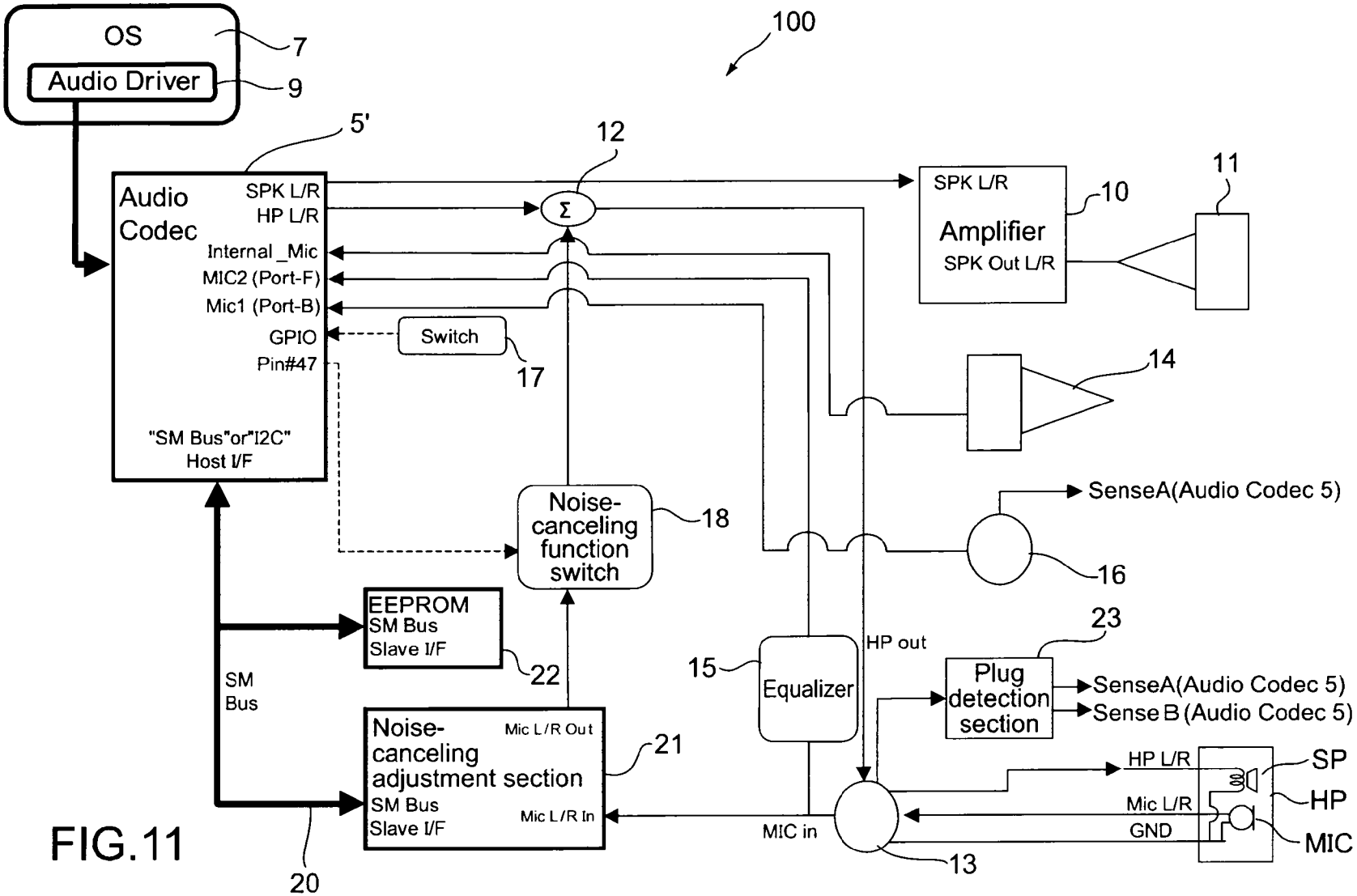
FIG. 11 is a diagram showing a configuration of an information processing apparatus according to another embodiment of the present invention.

FIG. 11 is a diagram showing a configuration of an information processing apparatus according to another embodiment of the present invention.

As shown in FIG. 11, an information processing apparatus 100 is different from the information processing apparatus 1 in the embodiment described above in that the noise-canceling adjustment section 21 and EEPROM 22 are controlled via an Audio Codec 5' instead of the ICH 4. Constituents common to the information processing apparatus 100 and the information processing apparatus 1 described above are denoted by the same reference numerals, and descriptions thereof are omitted.

The Audio Codec 5' includes a terminal of an SM Bus Host I/F. In this regard, the Audio Codec 5' is different from the Audio Codec 5 of the embodiment first described. In place of the SM Bus Host I/F, an I2C (Inter-Integrated Circuit) Host I/F may be used.

To the SM Bus Host I/F, the SM Bus 20 is connected.

To the SM Bus 20, the noise-canceling adjustment section 21 and EEPROM 22 are connected.

In this embodiment, the Audio Codec 5' is provided with a general-purpose I/F such as an SM Bus or an I2C, with the result that all the control of the noise-canceling function can be performed by the Audio Driver 9 that controls the Audio Codec 5'.

(Still Another Configuration of Information Processing Apparatus)

Figure 12:
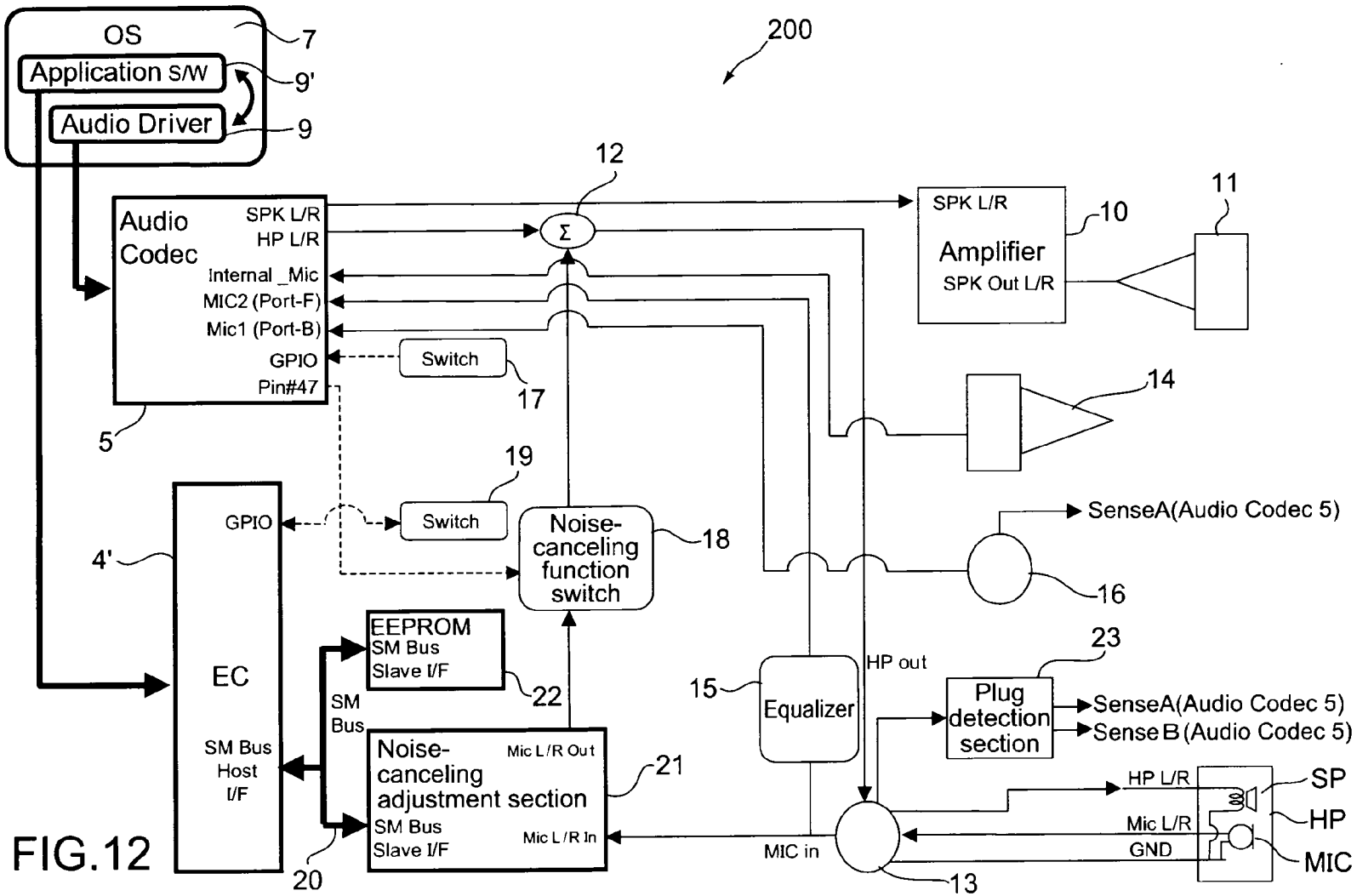
FIG. 12 is a diagram showing a configuration of an information processing apparatus according to still another embodiment of the present invention.

FIG. 12 is a diagram showing a configuration of an information processing apparatus according to still another embodiment of the present invention.

As shown in FIG. 12, an information processing apparatus 200 is different from the information processing apparatus 1 of the embodiment first described in that the noise-canceling adjustment section 21 and the EEPROM 22 are controlled via an EC (Embedded Controller) 4' instead of the ICH 4. The information processing apparatus 200 is different from the information processing apparatus 1 of the embodiment first described in that dedicated driver software 9' controls the EC 4' instead of the Audio Driver 9. In FIG. 12, constituents common to the information processing apparatus 200 and the information processing apparatus 1 first described are denoted by the same reference numerals, and descriptions thereof are omitted.

The EC 4' includes terminals of an SM Bus Host I/F and a GPIO like the ICH 4.

Connected to the GPIO is a switch 19 that is set in accordance with on/off of the noise-canceling function.

To the SM Bus Host I/F, the SM Bus 20 is connected.

The noise-canceling adjustment section 21 and the EEPROM 22 are connected to the SM Bus 20.

In this embodiment, the dedicated driver software 9' can control the noise-canceling function in association with the Audio Driver 9.

(Another Configuration for Detecting Noise-Canceling Headphone)

Figure 13:
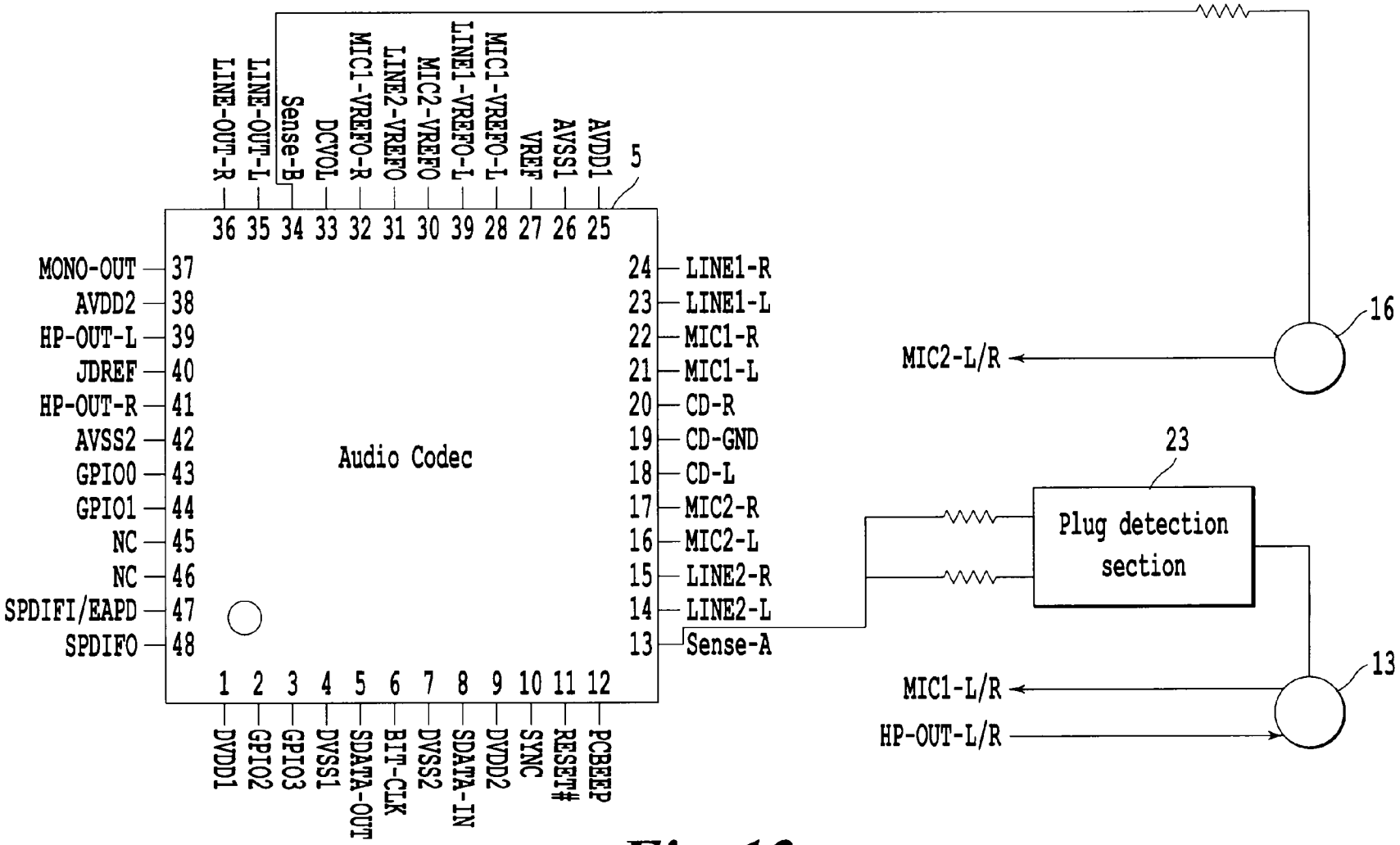
FIG. 13 is a diagram showing another wiring example between a plug detection section and an Audio Codec.

FIG. 13 is a diagram showing another wiring example between the plug detection section 23 and the Audio Codec 5.

As shown in FIG. 13, both a headphone detection signal and a microphone detection signal of the plug detection section 23 are input to the Sense A of the Audio Codec 5. A microphone detection signal from a microphone-connecting jack 16 is input to the Sense B of the Audio Codec 5.

When a microphone input signal of the headphone-connecting jack 13 is to be input to a MIC1-L/R instead of a MIC2-L/R, an input pin of the Audio Codec 5 is switched, and a Sense pin assigned to that pin becomes the Sense A. Accordingly, as shown in FIG. 13, a detection signal of the noise-canceling headphone HP can be detected only by the Sense A. That is, it is possible to distinguish a plug of a headphone noncompliant with noise canceling from a plug of the noise-canceling headphone HP and vice versa only by the Sense A.

(Others)

The present invention is not limited to the embodiments described above, and various modifications can be made within its technical idea.

For example, in the embodiments described above, a laptop personal computer has been described as an example of the information processing apparatus. However, the present invention is applicable to any information processing apparatus as long as it is an information processing apparatus that uses an OS, such as a desktop personal computer.

The headphone described in the embodiments above includes earphones as already described above.

The present application contains subject matter related to that disclosed in Japanese Priority Patent Application JP 2008-231576 filed in the Japan Patent Office on Sep. 9, 2008, the entire content of which is hereby incorporated by reference.

It should be understood by those skilled in the art that various modifications, combinations, sub-combinations and alterations may occur depending on design requirements and other factors insofar as they are within the scope of the appended claims or the equivalents thereof.

What is claimed is:

1. An information processing apparatus, comprising:

a jack connectable with a plug of a headphone including a microphone, the jack for outputting a first signal to the headphone and for inputting a second signal from the microphone;

a noise-canceling adjustment section to generate and output, based on the second signal input from the jack, a third signal that cancels a noise component around the headphone;

a signal superposition section to superpose the third signal on the first signal;

an SM bus, wherein the SM bus exchanges signals with the noise-canceling adjustment section at an operating system level of a hierarchical structure of software of the information processing apparatus; and a control section to control the noise-canceling adjustment section to cancel the noise component around the headphone, via the SM bus.

2. The information processing apparatus according to claim 1, wherein the control section includes one of an I/O controller hub and a system controller hub that outputs an electrical signal for controlling the noise-canceling adjustment section to the SM bus.

3. The information processing apparatus according to claim 1, further comprising a storage section that is connected to the SM bus and stores an initial value of the noise-canceling adjustment section.

4. The information processing apparatus according to claim 1, further comprising a detection section to detect, when a plug of an object is connected to the jack, which of the headphone and another object the object is in accordance with a change in a voltage of the jack, and notify, when it is detected that the object is the headphone, a result of the detection to the control section.

5. The information processing apparatus according to claim 1, further comprising an output section to output a signal of an operation screen for adjusting the noise-canceling adjustment section.

6. The information processing apparatus according to claim 5, wherein the operation screen for adjusting the noise-canceling adjustment section displays a switch for making a switch as to whether to cancel the noise component around the headphone.

7. The information processing apparatus according to claim 5, wherein the operation screen for adjusting the noise-canceling adjustment section displays an adjustment section for adjusting a degree of canceling the noise component around the headphone.

8. The information processing apparatus according to claim 1, further comprising an input line to import the second signal input from the jack as a microphone input signal of the information processing apparatus.

9. The information processing apparatus according to claim 1, wherein the information processing apparatus is a personal computer including a hardware audio codec.

10. The information processing apparatus according to claim 1, wherein the noise-canceling adjustment section is controlled without using applications.

11. An information processing apparatus, comprising:

an information processing section including a CPU and a controller hub that includes one of an I/O controller hub and a system controller hub;

an SM bus connected to the controller hub;

a noise-canceling adjustment section, which is connected to the SM bus and controlled by the information processing section to generate and output, based on a first signal input from a microphone of a headphone, a second signal that cancels a noise component around the headphone, wherein the SM bus exchanges signals with a noise-canceling adjustment section at an operating system level of a hierarchical structure of software of the information processing apparatus; and a signal superposition section to superpose the second signal on a third signal output to the headphone.

12. An information processing method for an information processing apparatus, comprising:

generating, based on a second signal input from a jack connectable with a plug of a headphone including a microphone, the jack outputting a first signal to the headphone and inputting the second signal from the microphone, a third signal that cancels a noise component around the headphone;

superposing the third signal on the first signal; and controlling, with a noise-canceling adjustment section, the generating the third signal, via an SM bus, to cancel the noise component around the headphone, wherein the SM bus exchanges signals with the noise-canceling adjustment section at an operating system level of a hierarchical structure of software of the information processing apparatus.

* * * * *